US005960963A

United States Patent [19]

Chodack et al.

[11] Patent Number: 5,960,963

[45] Date of Patent: Oct. 5, 1999

[54] SORTING DEVICE FOR AN INSERTING SYSTEM

[75] Inventors: Jeffrey L. Chodack, New Milford; Joseph H. Marzullo, Brookfield, both of Conn.

[73] Assignee: Pitney Bowes Inc., Stamford, Conn.

[21] Appl. No.: 08/880,548

[22] Filed: Jun. 23, 1997

[51] Int. Cl.[6] ..... B07C 9/00

[52] U.S. Cl. ..... 209/657; 209/540; 209/900; 271/177; 271/185

[58] Field of Search ..... 209/540, 541, 209/542, 545, 656, 657, 900; 271/177, 178, 184, 185

[56] References Cited

U.S. PATENT DOCUMENTS

| | | | |
|---|---|---|---|
| 4,570,922 | 2/1986 | Akers | 271/178 |
| 4,718,660 | 1/1988 | Daboub | 271/305 |
| 5,226,547 | 7/1993 | Malatesta | 209/900 X |
| 5,330,174 | 7/1994 | Ricciardi | 271/185 X |
| 5,429,249 | 7/1995 | Belec et al. | 209/584 |
| 5,570,172 | 10/1996 | Acquaviva | 355/323 |
| 5,755,336 | 5/1998 | Rudy | 209/657 X |

FOREIGN PATENT DOCUMENTS

| | | | |
|---|---|---|---|
| 2555918 | 6/1985 | France | 209/657 |

*Primary Examiner*—Tuan N. Nguyen
*Attorney, Agent, or Firm*—Christopher J. Capelli; Melvin J. Scolnick

[57] ABSTRACT

The present invention provides a sorter for sorting mailpieces into one of at least two sorting bins, the sorter having a transport device for conveying the mailpieces along a transport path. Each sorting bin includes a drive nip located in close proximity to a gate assembly for conveying a mailpiece away from the transport path and into the sorting. Each sorting bin further includes a stacking belt assembly spaced away from the drive nip and having a first end positioned at an acute angle relative to the drive nip and second end positioned adjacent a registration wall.

17 Claims, 9 Drawing Sheets

CONFIGURE BINS-ASSIGN SORT DESIGNATION
200
IDENTIFY SOURCE OF MAILPC DATA CODE OR FILE
202
204
GET NEXT MAILPIECE & SCAN
DETERMINE SORT DESIGNATION
206
216
208
STACK MAILPC IN SORT BIN
NO
SORT BIN STACK SIZE FULL?
YES
TURN BIN OFFLINE & PRINT SORT DESTINATION TAG
210
214
212
218
SET TO CURRENT BIN FOR SORT DESIGNATION
YES
ALTERNATE SORT BIN AVAILABLE?
NO
SEND MAILPC TO RESIDUAL BIN

SORTING DEVICE FOR AN INSERTING SYSTEM

FIELD OF THE INVENTION

The present invention relates generally to sorting devices, and more particularly, to apparatus for sorting mailpieces at the output of inserting systems.

BACKGROUND OF THE INVENTION

Throughout the history of mail delivery, there has been a gradual evolution whereby the post office encourages mailers to prepare their mail in such a way as to reduce the effort required on the part of the post office for processing such mail. As an inducement to the mailer to prepare the mail in such a way so as to bring about faster mail delivery, the post office offers several levels of postage discount to mailers. The level of discount typically is based on the number of criteria met by the mailer. For example, in order to maximize such postage discounts, the post office requires that high volume mailers presort the mailpieces, apply a Zip+4 bar code to each mailpiece, and package their mail into trays with each tray tagged in accordance with the Domestic Mail Manual.

Previously, large volume mailers have performed the sorting process on conventional off-line sorting equipment, however the traying process is still performed manually. Smaller volume mailers may perform both the sorting and traying processes manually. Clearly such manual traying is not efficient for large volume mailers.

As described in commonly assigned U.S. Pat. No. 5,429,249 to Belec et al., this drawback was overcome by the direct interface of a multi-bin sorting device with an inserter system. This inserter system performs automated sorting of mailpieces in accordance with predetermined postal discount requirements. Essentially, the system consists of an inserter for assembling the mailpieces and a sorter coupled to the inserter for automatically sorting and traying the mailpieces. The sorter includes a sorter controller and a plurality of on-edge sorting bins. The system also includes means for communicating mailpiece data and configuration data to the sorter controller. The sorter controller controls the sorting of mailpieces received from the inserter into sort groups according to postal discount requirements.

In order to prevent the occasional jamming of mailpieces as they are diverted into designated trays of the sorter device; the inserter system implemented an anti-jamming kicker gate. The kicker gate, when actuated, aligns with the actuated gate of a tray to allow smooth entry of a mailpiece from a transport of the inserter system into a tray of the sorting device. Upon deactuation, the kicker gate returns to its original position thereby "kicking" the tail of the mailpiece inwardly into the tray and away from the entry area of the tray. Such a kicker-gate mechanism is described in U.S. Pat. No. 4,718,660 to Daboub. But, even though this kicker gate proved to be reliable it suffered from occasional drawbacks in that the kicking gate occasional damaged a mailpiece through its "kicking" action against a mailpiece. Additional, this anti-jamming mechanism is complex and expensive to implement because it requires an exact timing scheme for actuation of the kicker gate.

Therefore, it is an object of the present invention to provide a sorting device that can be implemented at the output end on an inserting system having an improved and simplified mechanism for preventing jamming of mailpieces that are conveyed into individual sorting bins of the sorting device.

SUMMARY OF THE INVENTION

The present invention provides an apparatus for sorting mailpieces according to requirements for receiving postal discounts. In a preferred embodiment, the sorter apparatus includes a sorter controller and a plurality of on-edge sorting bins. The system also includes means for communicating mailpiece data and configuration data to the sorter controller. The sorter controller controls the sorting of mailpieces received from the inserter into sort groups according to postal discount requirements.

In order to convey a mailpiece into a sorting bin, each bin includes a gate movable between a first position and a second position. When the gate is actuated to the first position, it permits a transport device to continue to convey a mailpiece along its transport path. And when the gate is actuated to the second position, it diverts a mailpiece from the transport path into an associated sorting bin. To facilitate stacking of the mailpieces in the sorting bin, each bin includes a drive nip positioned in close proximity to the gate for conveying a mailpiece away from the transport path and into the sorting bin when the gate assembly is actuated in the second position. Further included is a stacking belt assembly spaced away from said drive nip and having a first end positioned at an acute angle relative to the drive nip and second end positioned adjacent the registration wall, wherein the drive nip is operative to convey a leading edge portion of the mailpiece to the first end of the stacking belt assembly whereafter the stacking belt assembly is operative to convey the leading edge of the mailpiece to the registration wall.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PREFERRED EMBODIMENT

Figure 1:
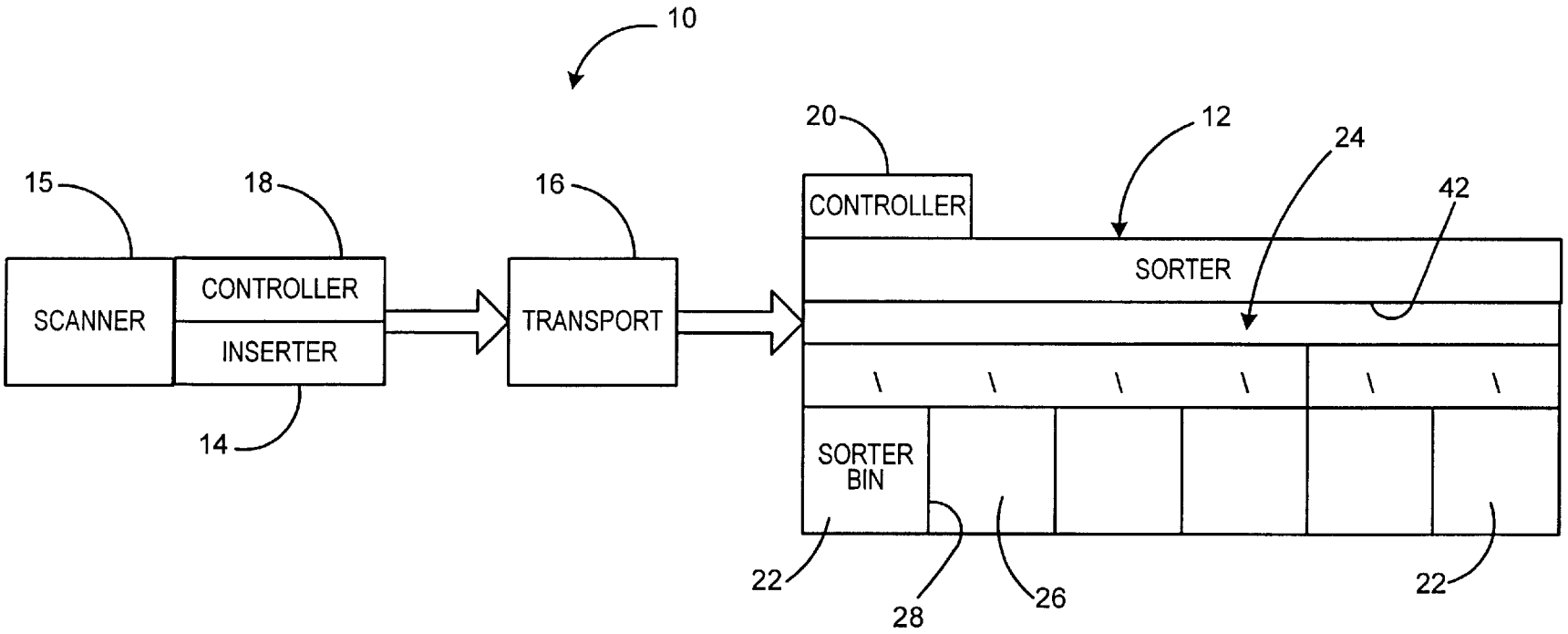
FIG. 1 is a block diagram of an inserter system including an on-line sorting module in accordance with the present invention.

In describing the present invention, reference is made to the drawings, wherein there is seen in FIG. 1 a block diagram of an inserter system, generally designated 10, which includes a sorting device, generally designated 12. It is to be appreciated that while the below described sorting device 12 is described in terms of a device which is "on-line" with inserter system 10, the sorting device 12 is not to be understood to be limited to such an "on-line" device, as it is to be understood to alternatively encompass a "stand-alone" sorting device. It is only for clarity of understanding of an inserting system 10 implementing sorting device 12 that the preferred embodiment of sorting device 12 is described in conjunction with inserter system 10.

As is conventional, inserter system 10 comprises an inserter device 14 that outputs mailpieces to a transport device 16 that conveys the mailpieces in seriatim to sorting device 12. For instance, the transport device 16 may consist of a turn-up and alignment device that turns the mailpieces on edge, bottom edge aligned. See U.S. Pat. No. 5,429,249 to Belec et al., incorporated herein by reference. Vertical transports are then preferably utilized to transport the mailpieces to an on-edge sorter/stacker (not shown). A more detailed description of such document transportation devices is disclosed in commonly assigned U.S. Pat. Nos. 5,368,287 and 5,411,250, both of which are hereby incorporated by reference.

As is also conventional, a controller 18 is implemented in inserter 14 and is configured to communicate with a controller 20 implemented in sorter 12 operative to instruct sorter 12 to sort mailpieces according to requirements for postal discounts, as will be discussed further below.

Figure 2:
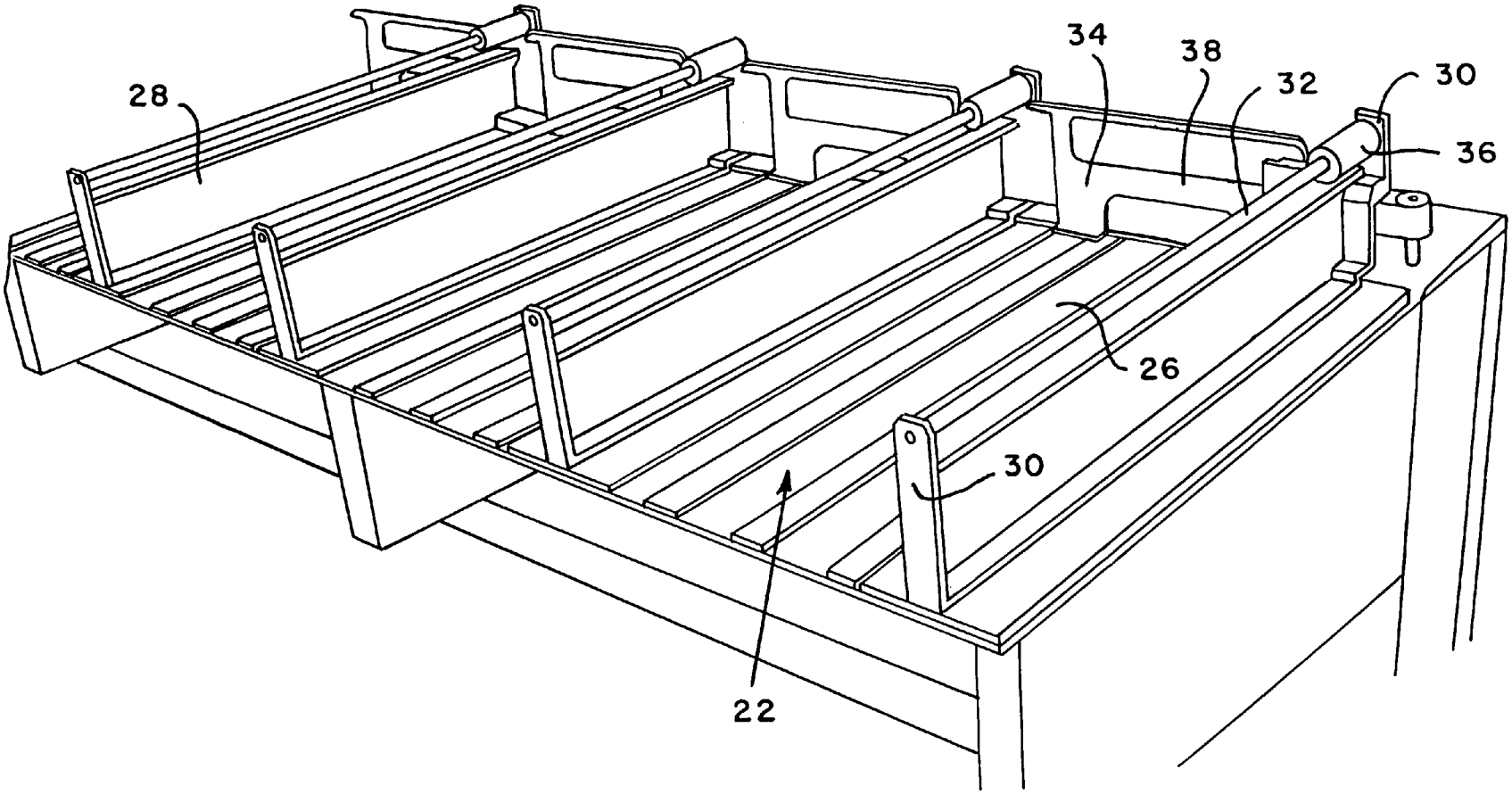
FIG. 2 is a perspective view of sorting bins of the on-line sorting module of FIG. 1.

With reference to FIGS. 1 and 2, sorter 12 includes a plurality of bins, each generally designated 22, and a vertical transport system, generally designated 24. Each bin 22 includes a base plate 26 and a fixed registration wall 28 that are mounted to base plate 26. Each registration wall 28 divides base plate 26 into separate bin sections. In the preferred embodiment of the present invention, four registration walls 28 are mounted at certain intervals along base plate 26 to make four separate bins. Each registration wall 28 includes a pair of end members 30 having a section thereof extending above the top of registration wall 28. Each registration wall 28 has a bar 32 that longitudinally extends above the top of the wall 28 and is mounted to the pair of end members 30. A paddle 34 is slidably mounted on each bar 32. Each paddle 34 includes at one end a cylinder-shaped member 36 that is orthogonal to its flat section 38. Cylinder member 36 includes an aperture through which paddle 34 is slidably mounted and is spring loaded on bar 32. In addition to moving up longitudinally along bar 32, paddle 34 can pivot about bar 32 allowing the removal of a mailpiece stack from the corresponding bin 22.

Figure 3:
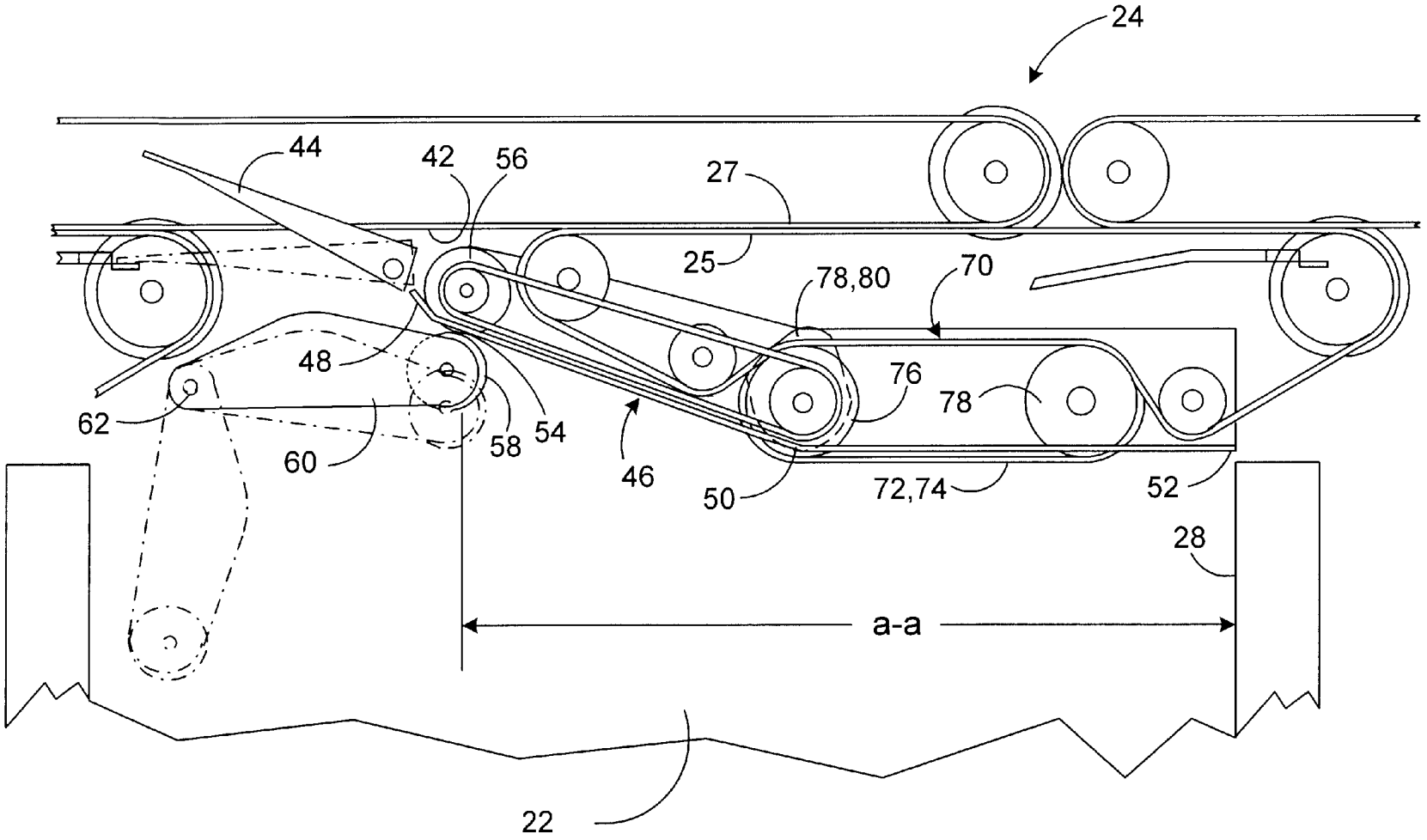
FIG. 3 is a top view of a sorting bin provided on the on-line sorting module of FIG. 1.

Referring now to FIGS. 1 and 3, sorter 12 is provided with a vertical transport assembly 24 that defines a transport path 42 for conveying mailpieces in the sorter 12. Vertical transport assembly 24 is preferably a dual belt system comprising a plurality of inner belt sections 25 and outer belt sections 27. Inner and outer belt sections 25 and 27 include conventional drive and idler pulleys around which endless elastic belts are stretched.

Each bin 22 has associated with it a pivoting gate 44 mounted adjacent to the transport path 42 that is pivotable between first and second positions. Each gate 44 is caused to be actuated by a destination signal originating from the controller 20 of sorter/stacker 12. As will be discussed further below, gate 44, when actuated, temporarily intersects the transport path 42 of the transport assembly 24 to thereby divert a mailpiece from the transport path 42 of the transport system 24 into an associated bin 22. Each gate 44 is located between inner belt section 25, adjacent to the inner reach of the outer belt section 27 and extends parallel to the transport path 42 of the vertical transport assembly 24. Gates 44 pivot at one end about a vertical axis. Each of gates 44 include a rectangular open section in the non pivoting end through which outer belt 27 travels when gates 44 pivot thereto (the second position). For instance, when in the first position, gates 44 permit a mailpiece to continue to convey along the transport path 42 to a succeeding downstream bin 22. When in the second position, gate 44 intersects transport path 42 thereby diverting a mailpiece away from transport path 42 and into its associated bin 22.

Each bin 22 further includes a lead-in entry guide plate 46 having a first end 48, a second end 50 and an intermediate portion 52. The first end 48 defines a cutout through which extends an outer periphery portion 54 of drive roller 56, which roller 56 is mounted in close proximity to gate 44. Forming a nip with roller 56 is idler roller 58. Idler roller 58 is rotatably mounted to an end of pivoting arm member 60, which has an opposing end pivotably mounted at hinge point 62. As best shown in FIG. 3, pivoting arm 60 is pivotable between a first position (causing idler roller 58 to form a nip with drive roller 56) and a second position (in which idler roller 58 is moved away from drive roller 56, as shown in phantom in FIG. 3). Preferably, pivoting arm member 60 is spring biased towards its first position and it is to be appreciated that the mechanism that causes the pivoting arm member 60 to pivot between its first and second positions (not shown) can be as simple or as complex as desired.

It is also to be appreciated that the nip formed by rollers 56 and 58 is positioned so as to expel a mailpiece whereby the mailpiece's leading edge portion first contacts the intermediate portion 50 of guide plate 46 after expulsion from the nip of rollers 56 and 58. As will be explained further below, this positioning of the nip is advantageous in that it prevents a mailpiece from jamming against or deflecting off guide plate 46, but rather the leading edge portion of the mailpiece is directly conveyed to stacking assembly 70 at the intermediate portion 50 of guide plate 46 after leaving the nip of rollers 56 and 58.

As will also be explained further below, in order to insure proper stacking of each mailpiece in a bin 22, when the distance between the outer periphery of drive roller 56 and the registration wall 28 (taken along line a—a) is greater than the length of a mailpiece (e.g., an envelope), the pivoting arm member 60 is caused to be positioned in the first position. Conversely, when the distance between the outer periphery of drive roller 56 and the registration wall 28 (taken along line a—a of FIG. 3) is less than the length of mailpiece, the pivoting arm member 60 is positioned in the second position (as shown in phantom in FIG. 3).

Figure 4:
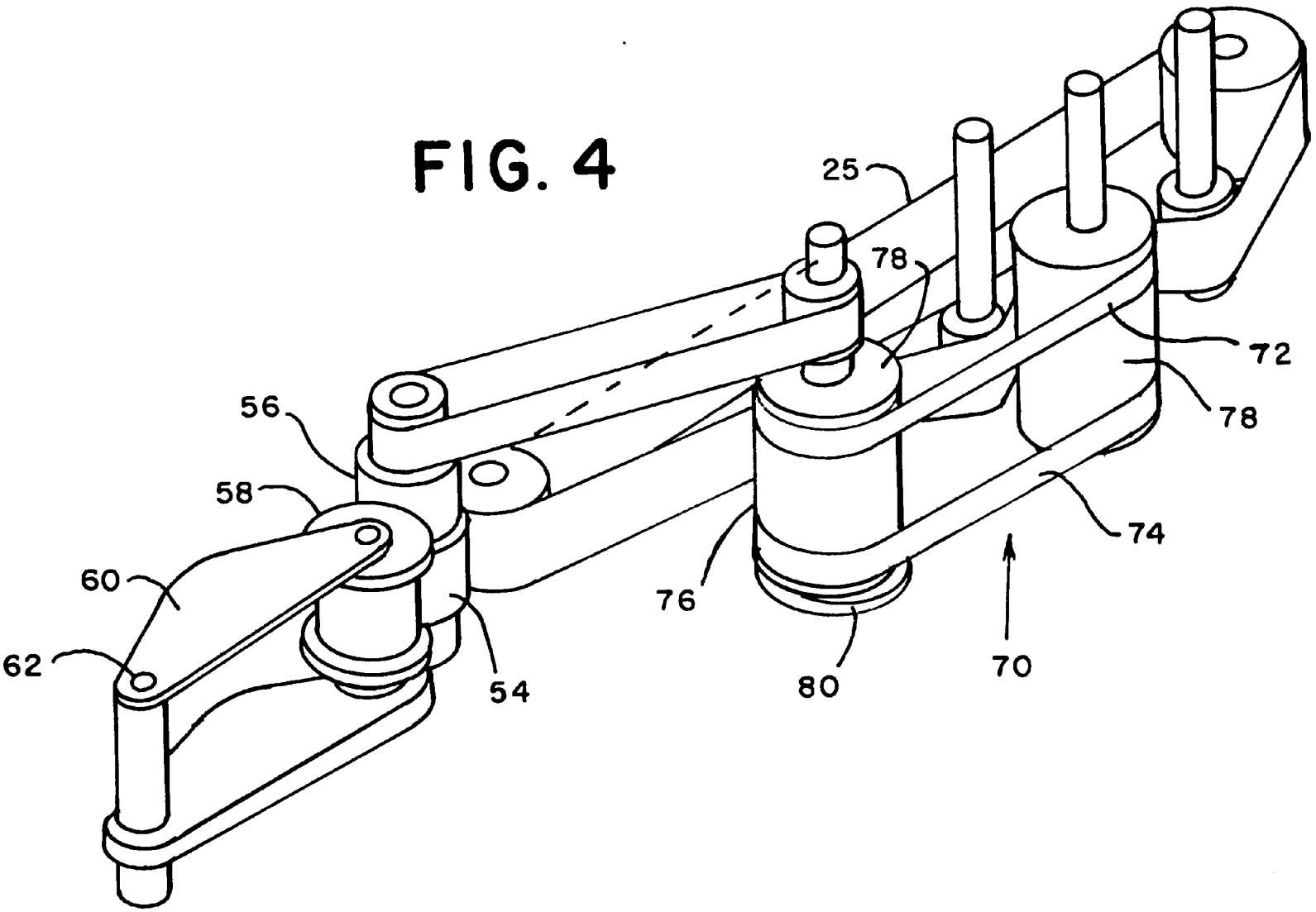
FIG. 4 is a perspective view of the sorting bin of FIG. 3.

As mentioned above, when arm 60 is positioned in the first position, idler roller 58 forms a nip with drive roller 56. This formed nip is shown in FIG. 4 in which the outer periphery of drive roller 56 has a central notched configuration and the outer periphery of idler roller 58 has a corresponding central protruding configuration dimensioned to at least partially receive within the notched configuration of drive roller 56 when arm 60 is positioned in the first position. It is pointed out that this "notched" nip is advantageous because when a mailpiece is passed and driven through the notched nip, the mailpiece is caused to curl which imparts beam strength upon the mailpiece thereby preventing fluttering of the mailpiece as it enters into a respective bin 22.

Each bin 22 further includes a stacking belt assembly 70 that is operational to urge and stack a mailpiece against the flat section 38 of paddle 34 (or a preceding mailpiece when at least one mailpiece has already been stacked against the flat section 38 of paddle 34) until the lead edge portion of the mailpiece hits registration wall 28. As best shown in FIG. 4 (having guide plate 46 removed for convenience of illustration), stacking belt assembly 70 consists of clockwise rotating upper and lower endless belts 72 and 74 wrapping around pulleys 76 and 78. Upper and lower belts 72 and 74 extend from the intermediate portion 50 of lead-in entry guide plate 46 to a region in proximity to the second end 52 of guide plate 46.

In order to further prevent jamming of the mailpiece in a bin 22 and to prevent the mailpiece from continuously rubbing against the rotating upper and lower belts 72 and 74, pulley 76 is provided with upper and lower eccentric wheels 78 and 80 which rotate in correspondence with upper and lower belts 72 and 74. It is noted that continuous rubbing of a mailpiece against any rotating surface can cause burning of the mailpiece as well as to cause premature wear on the rotating surfaces of the upper and lower belts 72 and 74. Lower eccentric wheel 80 is mounted to pulley 76 at a region below lower belt 72 and upper eccentric wheel 78 is mounted to pulley 76 at a region above upper belt 74. Upper and lower eccentric wheels 78 and 80 are preferably identical in configuration to one another and when the wheels 78 and 80 are caused to rotate on pulley 76, they rotate in an eccentric pattern wherein at least a portion of the upper and lower eccentric wheels 78 and 80 respectively rotate beyond the upper and lower belts 72 and 74 so as to engage a mailpiece being conveyed from the transport path 42 (via gate 44) causing the mailpiece to temporarily flutter away from the surfaces of upper and lower belts 72 and 74.

Figure 5:
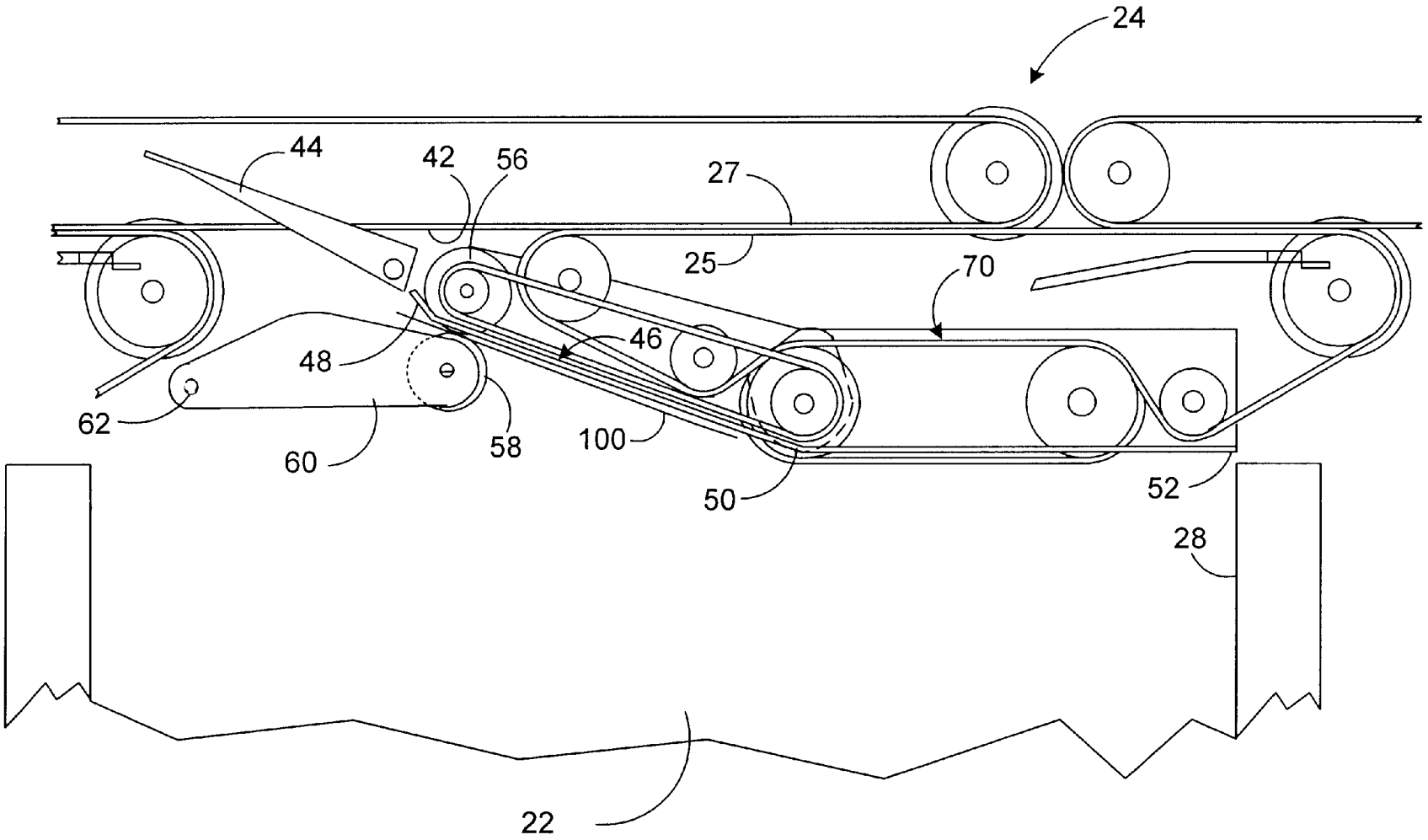
FIGS. 5–8 are top views illustrating various processing stages of a mailpiece in a sorting bin of the on-line sorting module of FIG. 1.

With the structure having been disclosed, and with reference to FIGS. 5–8, the operation of sorter 12 is set forth. Referring to FIG. 5, a mailpiece 100 is conveyed to sorter 12 from an upstream module (e.g., transport device 16). As the mailpiece 100 is transported preferably on edge by vertical transport system 42, the control system 20 for sorter 12 causes a gate 44 of bin 22 to deflect momentarily toward the adjacent outer belt 27. This causes the mailpiece 100 to deflect off gate 44 wherein the leading edge of mailpiece 100 enters into the nip formed by rollers 56 and 58. The nip of rollers 56 and 58 then drives mailpiece 100 away from transport assembly 42 and through the nip such that the leading edge of mailpiece 100 first comes into contact with the intermediate portion 50 of lead-in entry guide plate 46.

Figure 6:
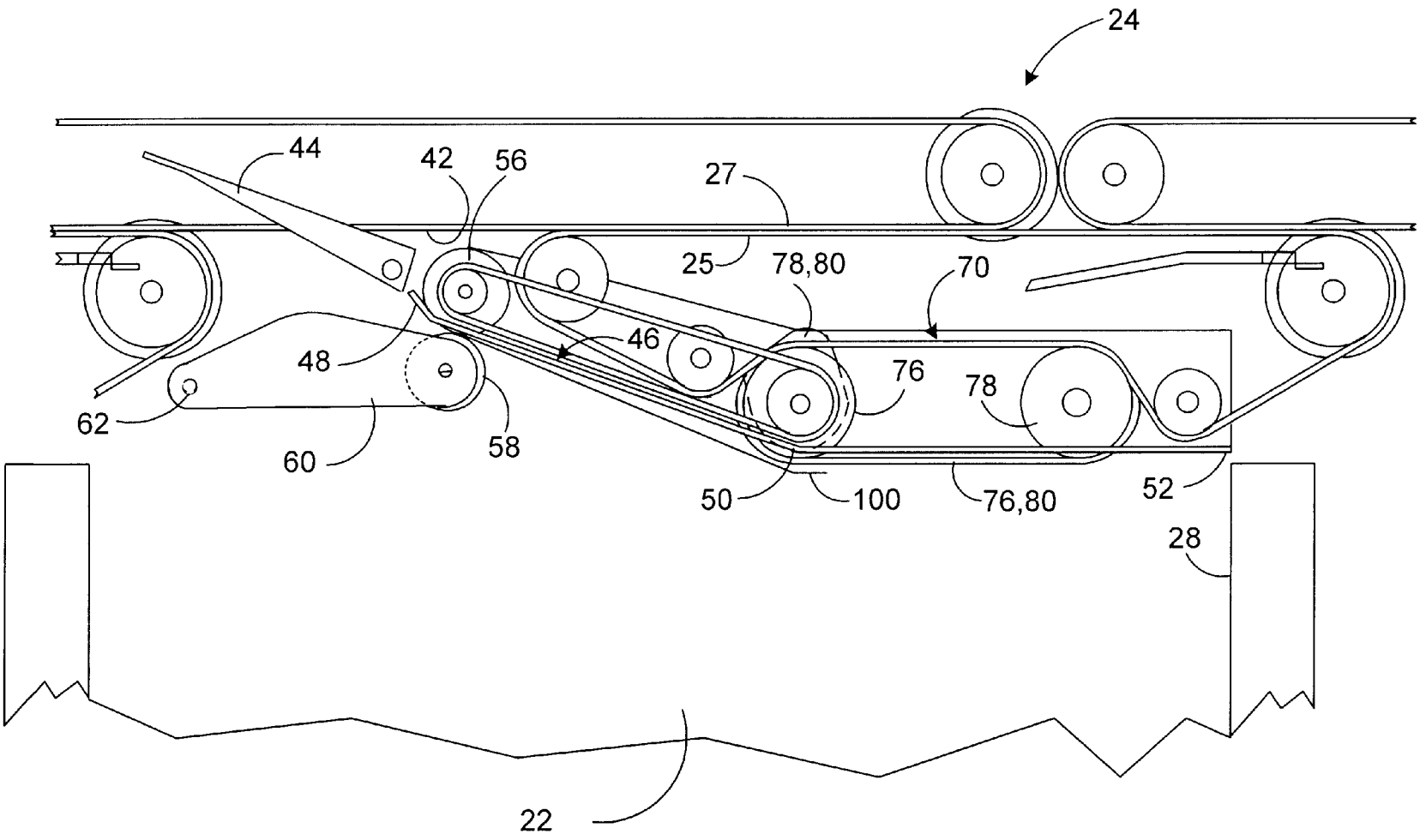
Figure 7:
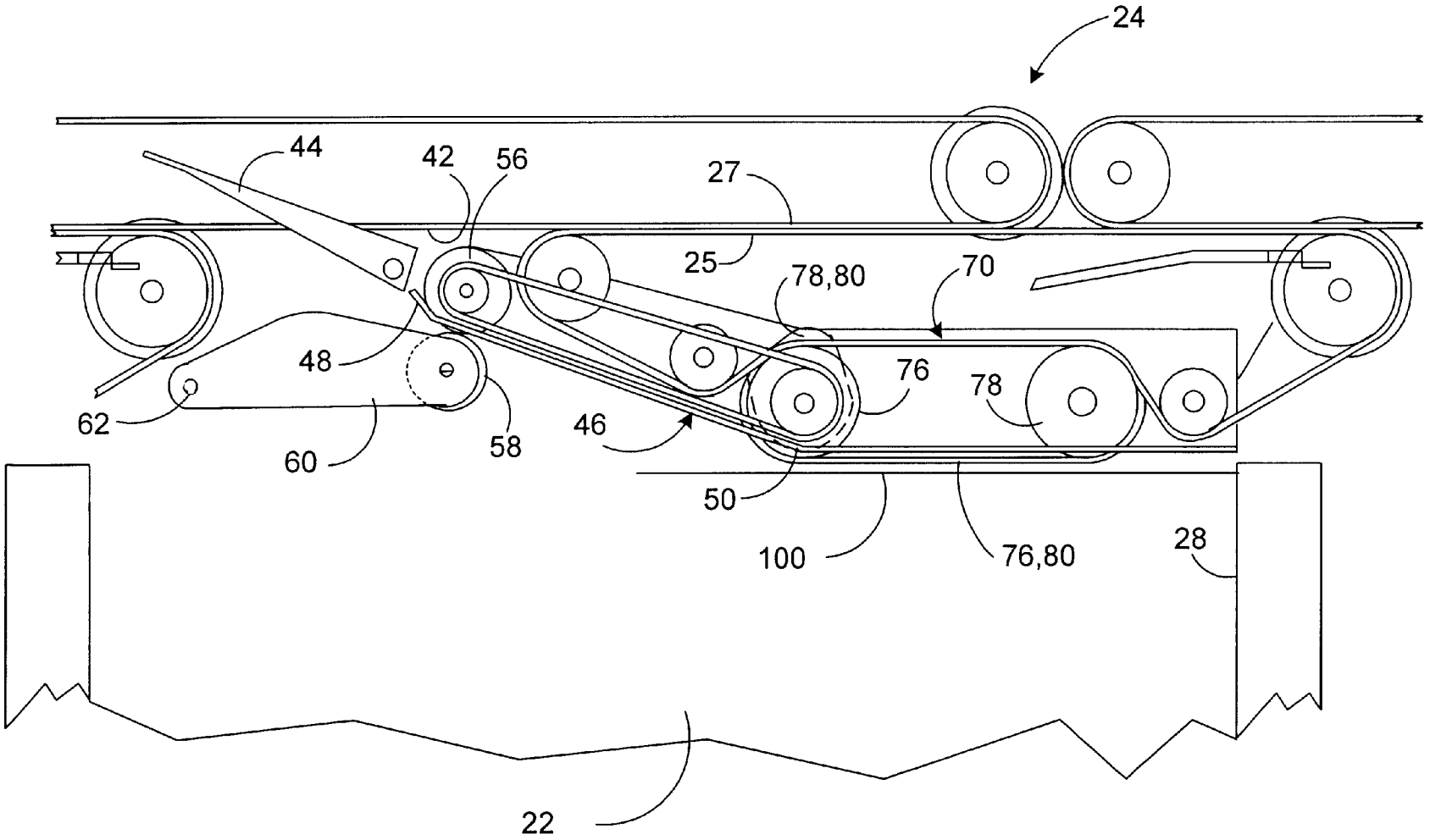

Referring now to FIG. 6, the leading edge portion of mailpiece 100 then engages the upper and lower belts 72 and 74 of stacking belt assembly 70 causing mailpiece 100 to advance towards fixed registration wall 28. Thereafter, the eccentric motion of upper and lower eccentric wheels 78 and 80 cause the mailpiece 100 to temporarily disengage with belts 72 and 74 ensuring the integrity of mailpiece 100 as well as providing longevity for belts 72 and 74. Once, or before (depending upon the size of the mailpiece) the leading edge portion of mailpiece 100 abuts against the registration wall 28, the tail edge of the mailpiece exits thorough the nip of rollers 56 and 58 whereafter the tail edge of mailpiece 100 falls flatly into place against the previously stacked mailpiece (or paddle 34 if bin 22 is empty), as shown in FIG. 7.

As previously mentioned, upper and lower belts 72 and 74 of stacking belt assembly 70 urge and stack mailpiece 100 against the previously stacked mailpiece (or paddle 32) until the lead edge of mailpiece 100 abuts against registration wall 28. Next, a succeeding mailpiece enters into bin 22 (upon instructions from the control system 20 of sorter 12), whereafter the above-described operation is once again repeated.

Figure 8:
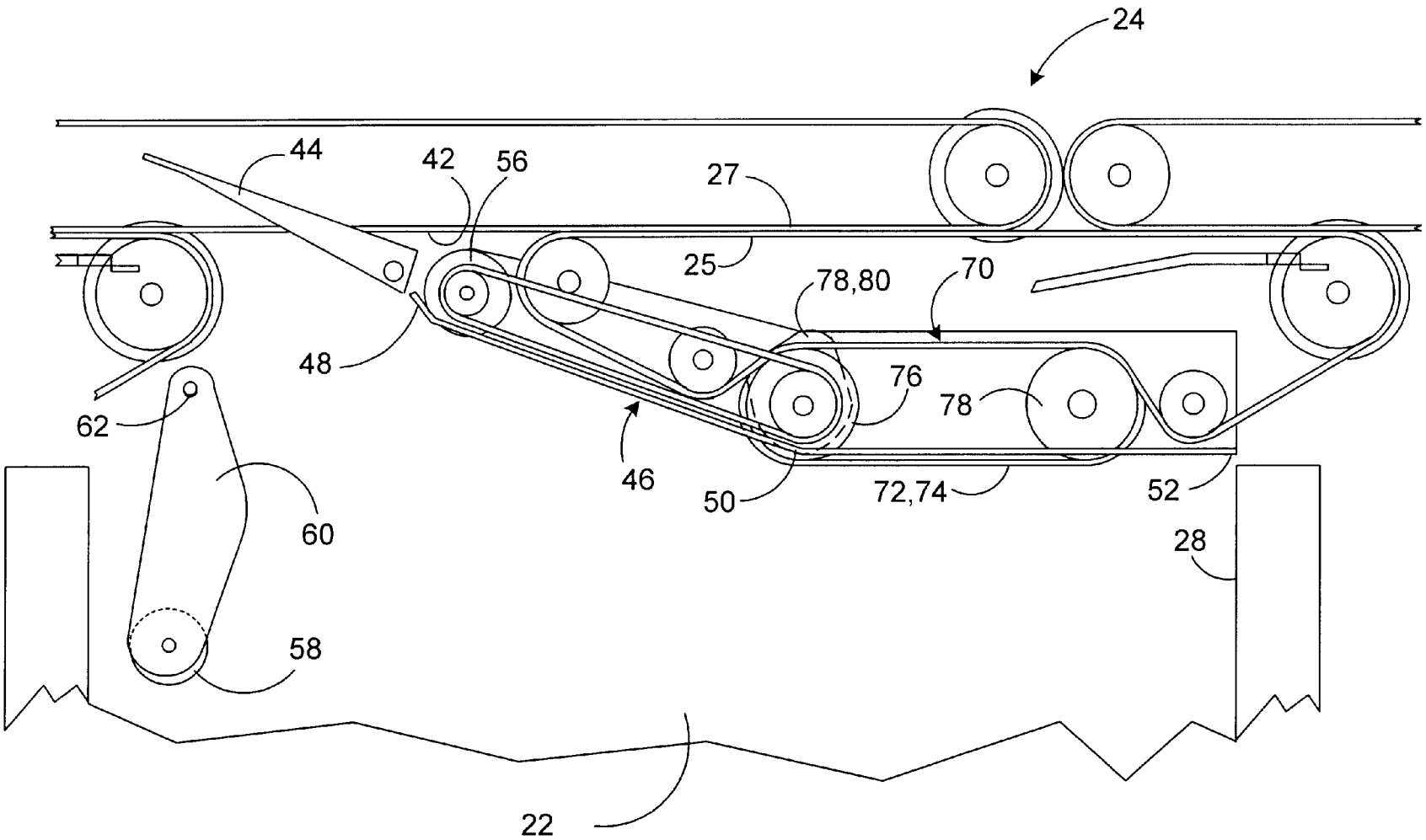

Referring now to FIG. 8, when sorter 12 is being used with mailpieces of a length greater than the distance between drive roller 56 and registration wall 29 (taken along line a—a)(FIG. 3) pivoting arm 60 is caused to be positioned in its second position. It is to be appreciated that pivoting arm 60 must be moved to the second position so as to allow the tail edge of an mailpiece to fall flatly into place against the previously stacked mailpiece (or paddle 34 if bin 22 is empty). If pivoting arm 60 was to remain in the first position, the tail edge of the mailpiece (being longer than line a—a of FIG. 3) would not be able to fall flatly against the previously stacked mailpiece when its leading edge abuts against the registration wall 28, but rather would remain in the nip of rollers 56 and 58.

It is also to be appreciated that sorter 12 preferably does not need a mechanism to perform the traditional "stack advance" function. Instead, the entire stacker bin is angulated at a specific angle. This allows gravity to act on the stack of mailpieces being accumulated in the stacker bin and advance the stack as additional pieces enter. There are certain very specific conditions which allow such a stacking device to be successful while stacking a great variety of different types of mailpieces to stack lengths of 22 inches or greater.

Figure 9:
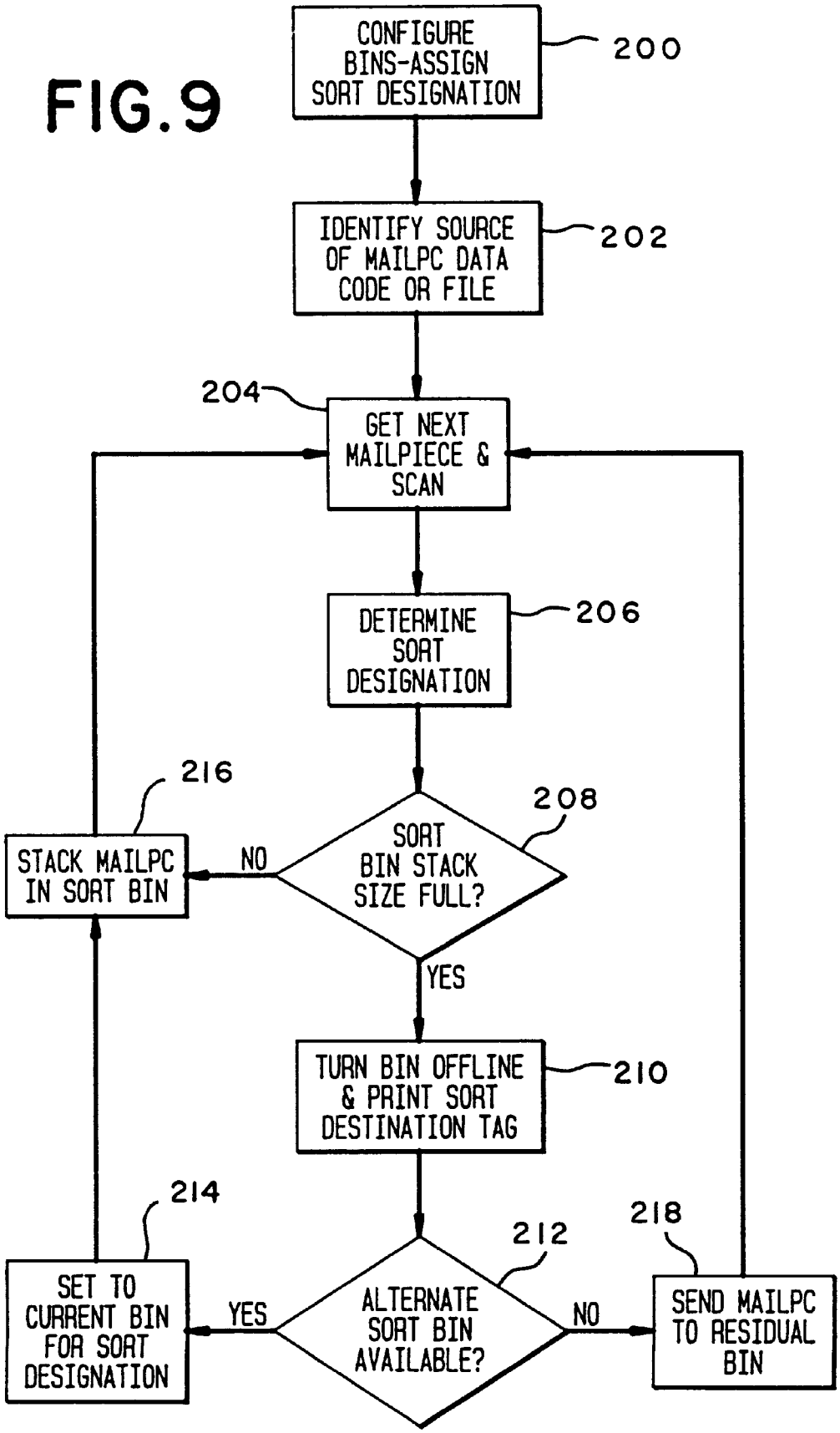
FIG. 9 is a flow chart of the sorting process.

Referring now to FIG. 9, a sorting algorithm performed by the sorter 12 is shown. On the basis of information received from inserter controller 18, sorting bins 22 are configured and assigned for sort designation at step 200. The source for mailpiece data code or file is identified at 202. The mailpiece processing begins at 204 when scanner 15 of inserter 14 scans a mailpiece. In the preferred embodiment of the present invention, mailpiece information is generally tracked with each mailpiece as it is assembled and processed in the inserter, such that the mailpiece can be sorted with the need for further scanning at sorter 12. However, any scanning at sorter 12 serves to improve the integrity of the sorting process by verifying the mailpiece is indeed the mailpiece expected based on the information received from inserter controller 18.

At 206, the sort designation is determined. At 208, the stack size of the bin into which the mailpiece is to be sorted is checked. If the bin is full, then, at 210, the bin is turned off-line, i.e., unavailable for further sorting, and a sort destination tag is printed for the stack in the bin. At, 212, controller 20 determines if an alternate sort bin is available. If there is one, at 214 the alternate sort bin is designated as a current sort bin. At 216, the mailpiece is stacked in the sort bin. If the bin stack size was less than full at 208, then at 216 the mailpiece is stacked in the sort bin and the processing moves on to the next mailpiece at 204. If no alternate sort bin is available at 212, the mailpiece is sent to a residual bin at 218.

It has been found that the present invention is particularly advantageous in that the combination of the nip formed by drive roller 56 and idler roller 58 of pivoting arm 60 with the stacking belt assembly 70 functions to prevent the jamming of a conveying mailpiece as it enters into a bin 22 of sorter 12. Specifically, by providing drive to the leading edge portion of the mailpiece, via stacking belt assembly 70, it eliminates the jamming of the leading edge portion of the mailpiece into the trailing edge of a preceding mailpiece positioned in the bin 22. Further, the provision of eccentric wheels 56 and 58 prevent burning of the mailpiece surface while providing longevity for the upper and lower belts 72 and 74 of stacking belt assembly 70. Additionally, the implementation of pivoting arm 60 enables a sorting bin to accommodate a wide range of mailpiece sizes without requiring adjustment for registration wall 28.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. A sorter for sorting mailpieces into one of at least two sorting bins, the sorter having a transport device for conveying the mailpieces along a transport path in the sorter and a gate assembly selectively operative in a first mode to permit the transport device to continue to convey a mailpiece along the transport path and in a second mode to divert a mailpiece from the transport path into the sorting bin; each sorting bin further comprising:

a drive nip consisting of a drive roller and an idler roller in close proximity to the gate assembly for conveying a mailpiece away from the transport path and into the sorting bin when the gate assembly is operative in the second mode; and a stacking belt assembly spaced away from the drive nip and having a first end positioned at an acute angle relative to the drive nip and second end positioned adjacent a registration wall, wherein the drive nip is operative to convey a leading edge portion of the mailpiece to the first end of the stacking belt assembly whereafter the stacking belt assembly is operative to convey the leading edge of the mailpiece to the registration wall.

2. A sorter as recited in claim 1 further including a guide plate extending between the drive nip and the first end of the stacking belt assembly.

3. A sorter as recited in claim 1 further including:

a controller; and means for communicating mailpiece data and configuration data to the sorter controller, wherein the sorter controller controls the sorting of mailpieces into sort groups according to postal discounts.

4. A sorter as recited in claim 1, wherein the drive roller has a central notched configuration and the idler roller has a corresponding central protruding configuration dimensioned to at least partially receive within the notched configuration of the drive roller.

5. A sorter as recited in claim 1 further including a pivoting arm being pivotable at a first end and having a second end rotatably mounting the idler roller, the pivoting arm being pivotable between first and seconds positions whereby when the pivoting arm member is positioned in the first position the idler roller is biased against the drive roller thereby forming the drive nip, and when positioned in the second position the idler roller is moved away from the drive roller.

6. A sorter for sorting mailpieces into one of at least two sorting bins, the sorter having a transport device for conveying the mailpieces along a transport path in the sorter and a gate assembly selectively operative in a first mode to permit the transport device to continue to convey a mailpiece along the transport path and in a second mode to divert a mailpiece from the transport path into the sorting bin; each sorting bin further comprising:

a drive nip in close proximity to the gate assembly for conveying a mailpiece away from the transport path and into the sorting bin when the gate assembly is operative in the second mode; and a stacking belt assembly spaced away from the drive nip and having a first end positioned at an acute angle relative to the drive nip and second end positioned adjacent a registration wall, wherein the drive nip is operative to convey a leading edge portion of the mailpiece to the first end of the stacking belt assembly whereafter the stacking belt assembly is operative to convey the leading edge of the mailpiece to the registration wall, wherein the stacking belt assembly includes at least one belt wrapped around at least one pulley and an eccentric wheel member mounted on the at least one pulley wherein the eccentric wheel member rotates in conjunction with the at least one belt and is operative to temporarily cause a mailpiece to move away from the at least one belt.

7. A sorter as recited in claim 6, wherein the stacking assembly includes first and second eccentric wheels respectively mounted to opposing first and second ends of the at least one pulley.

8. A sorter as recited in claim 7, wherein the stacking assembly includes first and second belts spaced substantially parallel to one another and wrapped around the at least one pulley.

9. An inserter system having an inserter for assembling mailpieces and a transport device for conveying the mailpieces along a transport path from the inserter to a sorter, the sorter having at least one sorting bin, the at least one sorting bin comprising: a a gate assembly selectively operative in at least one of first and second modes, when in the first mode the gate permits the transport device to continue to convey a mailpiece along the transport path and when in the second mode the gate diverts a mailpiece from the transport path into the sorting bin;

a drive nip consisting of a drive roller and an idler roller in close proximity to the gate assembly for conveying a mailpiece away from the transport path and into the sorting bin when the gate assembly is operative in the second mode;

a registration wall extending from an entry end of the sorting bin to a termination end of the sorting bin;

a stacking belt assembly spaced away from the drive nip and having a first end positioned at an acute angle relative to the drive nip and a second end positioned adjacent the registration wall, wherein the drive nip is operative to convey a leading edge portion of the mailpiece to the first end of the stacking belt assembly whereafter the stacking belt assembly is operative to convey the leading edge of the mailpiece to the registration wall.

10. An inserter system as recited in claim 9 further including:

a controller provided in the sorter; and means for communicating mailpiece data and configuration data to the sorter controller, wherein the sorter controller controls the sorting of mailpieces received from the inserter into sort groups according to postal discounts.

11. A sorter as recited in claim 9, wherein the transport device includes a turn-up and alignment device located between the sorter and an inserter, the turn-up and alignment device turning the mailpieces from a horizontal alignment out of the inserter to a vertical alignment into the sorter.

12. A sorter as recited in claim 9 further including a guide plate extending between the drive nip and the first end of the stacking belt assembly.

13. A sorter as recited in claim 9, wherein the drive roller has a central notched configuration and the idler roller has a corresponding central protruding configuration dimensioned to at least partially receive within the notched configuration of the drive roller.

14. A sorter as recited in claim 13 further including a pivoting arm being pivotable at a first end and having a second end rotatably mounting the idler roller, the pivoting arm being pivotable between first and second positions whereby when the pivoting arm member is positioned in the first position the idler roller is biased against the drive roller thereby forming the drive nip, and when positioned in the second position the idler roller is moved away from the drive roller.

15. A sorter as recited in claim 9, wherein the stacking belt assembly includes at least one belt wrapped around at least one pulley and an eccentric wheel member mounted on the at least one pulley wherein the eccentric wheel member rotates in conjunction with the at least one belt and is operative to temporarily cause a mailpiece to move away from the at least one belt.

16. A sorter as recited in claim 15, wherein the stacking assembly includes first and second eccentric wheels respectively mounted to opposing first and second ends of the at least one pulley.

17. A sorter as recited in claim 16, wherein the stacking assembly includes first and second belts spaced substantially parallel to one another and wrapped around the at least one pulley.

* * * * *